US005410388A

United States Patent [19]

Pacer et al.

[11] Patent Number: 5,410,388

[45] Date of Patent: Apr. 25, 1995

[54] AUTOMATIC COMPENSATION FOR TONER CONCENTRATION DRIFT DUE TO DEVELOPER AGING

[75] Inventors: James M. Pacer; Brendan C. Casey, both of Webster; George F. Bergen, Penfield; Patricia J. Weber, Fairport; William M. OuYang, Pittsford; Vilmarie Lopez-Heroux, Rochester, all of N.Y.

[73] Assignee: Xerox Corporation, Stamford, Conn.

[21] Appl. No.: 61,949

[22] Filed: May 17, 1993

[51] Int. Cl.[6] ..... G03G 21/00

[52] U.S. Cl. ..... 355/208; 118/688; 355/214; 355/246

[58] Field of Search ..... 355/208, 281, 246, 203, 355/326 R, 327, 214, 218; 118/688–691

[56] References Cited

U.S. PATENT DOCUMENTS

| | | | |
|---|---|---|---|
| 4,519,695 | 5/1985 | Murai et al. | 118/691 X |
| 4,980,723 | 5/1990 | Buddendeck et al. | 355/218 |
| 4,999,673 | 3/1991 | Bares | 355/208 |
| 5,023,668 | 6/1991 | Kluy et al. | 355/281 |
| 5,122,835 | 6/1992 | Rushing et al. | 355/208 |
| 5,253,018 | 10/1993 | Takenchi et al. | 355/246 |

*Primary Examiner*—A. T. Grimley
*Assistant Examiner*—Shuk Y. Lee
*Attorney, Agent, or Firm*—Ronald F. Chapuran

[57] ABSTRACT

A method of maintaining consistent large solid area development by developing a large area test patch covering the image area of a photorececptor and detecting the lead edge and trail edge density of the test patch using a densitometer to measure reflectance. If a density differential between lead and trail edge density is detected, electrostatic parameters such as toner concentration, developer bias, and photoreceptor potential are adjusted to maintain constant large solid area development.

8 Claims, 5 Drawing Sheets

AUTOMATIC COMPENSATION FOR TONER CONCENTRATION DRIFT DUE TO DEVELOPER AGING

BACKGROUND OF THE INVENTION

The invention relates to optimization of the xerographic process, and more particularly, to the automatic compensation for toner concentration drift due to developer aging.

One benchmark in the suitable development of a latent electrostatic image on a photoreceptor by toner particles is the correct toner concentration in the developer. An incorrect concentration, i.e. too much toner concentration, can result in too much background in the developed image. That is, the white background of an image becoming gray. On the other hand, too little toner concentration can result in deletions or lack of toner coverage of the image.

Under prior art process controls, a relatively small toner control patch is developed and sensed to adjust the development process to maintain the quality of developed small solid areas.

Specifically, many machines (both copiers and printers) use optical feed back from toner patches to control DMA (developed mass per unit area). The toner patch is developed to a partially discharged region of a photoreceptor. In toner patch based DMA control systems, the patch voltage is held constant. The controller attempts to keep the reflectance of the toner patch in range using the toner dispenser as an actuator. When the toner patch reflectance is high (the patch is too light) toner is added. The assumption is that if toner is added in such a way that the toner patch reflectance is kept at its target value then the DMA of the printed foreground will be kept at its target. Toner patches are developed to partially discharged belt areas because patches developed to fully charged areas would be saturated black and have insufficient sensitivity to DMA to control toner concentration TC. To create a toner patch on a printer a small region of the photoreceptor is initially left unexposed (fully charged). A special discharge lamp is then used to reduce its surface potential to a target value a fixed number of volts above the developer bias. Toner is then developed to the patch and its reflectance is read by the optical sensor. As the toner patch gets developed toner is deposited on it until the development field is sufficiently neutralized. With highly charged toner, less toner will be developed to the patch and its reflectance will be below target causing toner to be added. With lower charged toner the opposite occurs.

The characteristic of some developer materials degrade over time. As the developer ages, its charging properties change and progressively lower toner concentrations are required to keep the toner patch reflectance at target. With some developer, the toner concentration gets set sufficiently low after as little as 30,000 prints that foreground solids can not be properly rendered. In this case sufficient toner is available to keep the low density toner patch at target but not enough toner is available to render the more demanding foreground solid areas.

An example of the prior art is, U.S. Pat. No. 4,999,673, assigned to the same assignee as the present invention, disclosing the use of a relatively small developed half tone image patch to regulate the developer parameters. However, these prior art small patch process controls are generally inadequate and insensitive to detect large solid area development deterioration as discussed above. It would be desirable, therefore, to provide a process control technique to detect deterioration in large, solid area development. It is also known in the prior art to use an electro-optic sensor or any other suitable sensor in the developer housing to determine toner concentration. The use of a sensor in the housing in addition to the IRD sensor normally used in adjusting development, however, adds additional cost and complexity to the system. It would also be desirable, therefore, to minimize additional cost and complexity in a developer control system that is capable of responding to large solid area development deterioration to maintain toner concentration and developed mass at a constant level throughout the life of the developer.

It is an object of the present invention therefore to provide a new an improved technique to detect deterioration in large, solid area development. It is another object of the present invention to minimize additional cost and complexity in a developer control system that is capable of responding to large solid area development deterioration to maintain toner concentration and developed mass at a constant level. Other advantages of the present invention will become apparent as the following description proceeds, and the features characterizing the invention will be pointed out with particularity in the claims annexed to and forming a part of this specification.

SUMMARY OF THE INVENTION

The present invention is concerned with a method of maintaining consistent large solid area development by developing a large area test patch covering the image area of a photoreceptor and detecting the lead edge and trail edge density of the test patch using a densitometer to measure reflectance. If a density differential between lead and trail edge density is detected, electrostatic parameters such as toner concentration, developer bias, and photoreceptor potential are adjusted to maintain constant large solid area development.

For a better understanding of the present invention, reference may be had to the accompanying drawings wherein the same reference numerals have been applied to like parts and wherein:

DETAILED DESCRIPTION OF THE DRAWINGS

DETAILED DESCRIPTION OF THE PREFERRED EMBODIMENT

Figure 1:
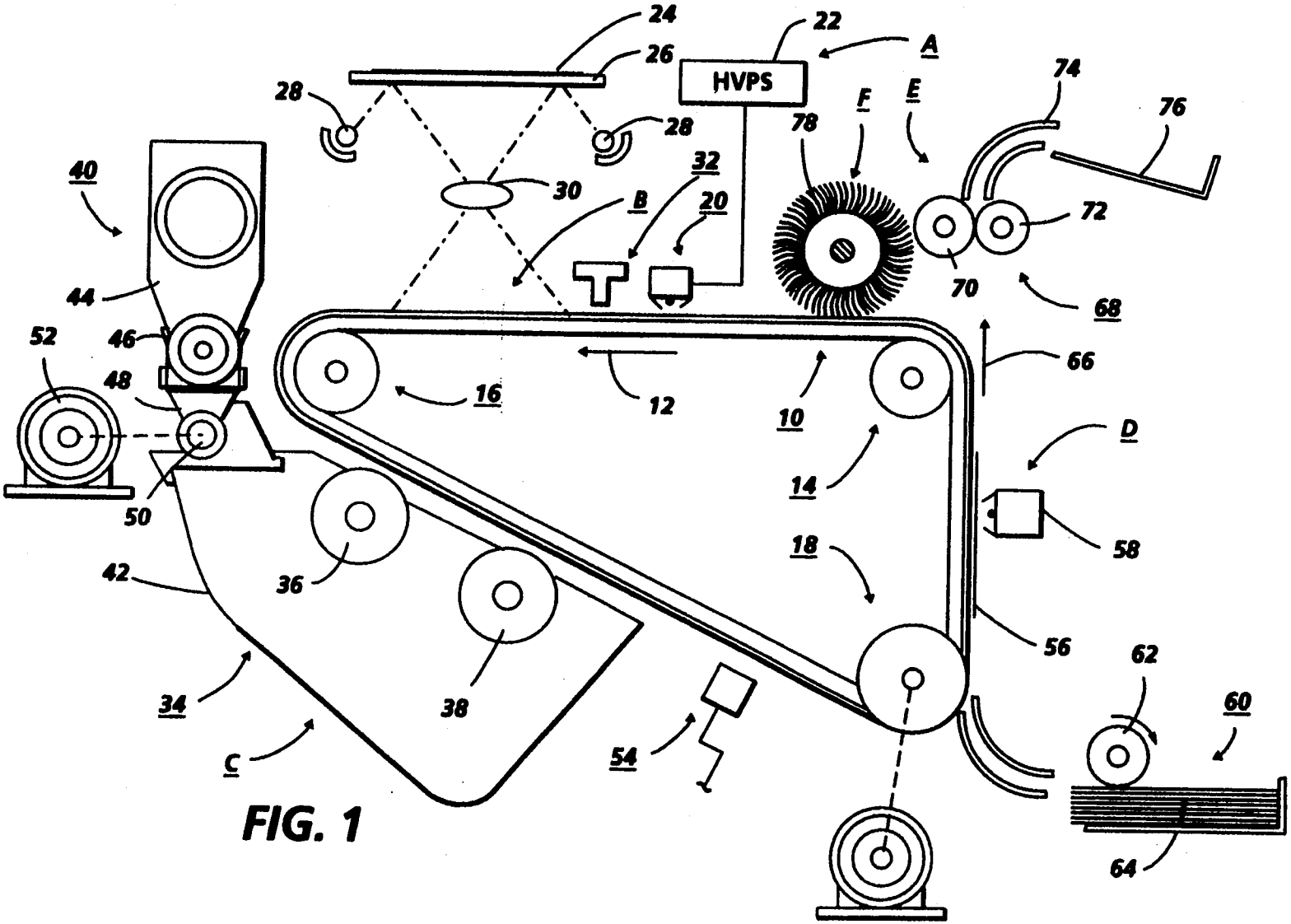
FIG. 1 is a schematic elevational view illustrating a typical electronic imaging system incorporating the features of the present invention.

FIG. 1 schematically depicts an electrophotographic printing machine incorporating the features of the present invention therein. It will become evident from the following discussion that the present invention may be employed in a wide variety of applications such as light lens and printer applications and is not specifically limited in its application to the particular embodiment depicted herein.

Referring to FIG. 1 of the drawings, the electrophotographic printing machine employs a photoconductive belt 10. Belt 10 moves in the direction of arrow 12 to advance successive portions of the photoconductive surface sequentially through the various processing stations disposed about the path of movement thereof. Belt 10 is entrained about stripping roller 14, tensioning roller 16, and drive roller 18. At charging station A, a corona generating device, indicated generally by the reference numeral 20, charges the photoconductive belt 10 to a relatively high, substantially uniform potential. Corona generating device 20 includes 20 includes a generally U-shaped shield and a charging electrode. A high voltage power supply 22 is coupled to the shield. A change in the output of power supply 22 causes corona generating device 20 to vary the charge applied to the photoconductive belt 10. Charging station A may be one of the processing stations regulated by the control system depicted in FIG. 2.

Next, the charged portion of the photoconductive surface is advanced through imaging station B. At imaging station B, an original document 24 is positioned face down upon a transparent platen 26. Imaging of a document is achieved by lamps 28 which illuminate the document on platen 26. Light rays reflected from the document are transmitted through lens 30. Lens 30 focuses the light image of the original document onto the charged portion of photoconductive belt 10 to selectively dissipate the charge thereon. This records an electrostatic latent image on the photoconductive belt which corresponds to the informational areas contained within the original document.

Imaging station B includes a test area generator, indicated generally by the reference numeral 32. Test generator 32 comprises a light source projecting light rays onto the charged portion of photoconductive belt 10, in the interimage region, i.e. between successive electrostatic latent images recorded on photoconductive belt 10. A test patch is recorded on photoconductive belt 10 typically a square approximately 5 centimeters by 5 centimeters as shown at 88 in FIG. 3. The electrostatic latent image and test patch are then developed with toner particles at development station C. In this way, a toner powder image and a developed test patch is formed on photoconductive belt 10. The developed test patch is subsequently examined to determine the quality of the toner image being developed on the photoconductive belt.

At development station C, a magnetic brush development system, indicated generally by the reference numeral 34, advances a developer material into contact with the electrostatic latent image and test patch recorded on photoconductive belt 10. Preferably, magnetic brush development system 34 includes two magnetic brush developer rollers 36 and 38. These rollers each advance the developer material into contact with the latent image and test areas. Each developer roller forms a brush comprising carrier granules and toner particles. The latent image and test patch attract the toner particles from the carrier granules forming a toner powder image on the latent image and a developed test patch. As toner particles are depleted from the developer material, a toner particle dispenser, indicated generally by the reference numeral 40, furnishes additional toner particles to housing 42 for subsequent use by developer rollers 36 and 38, respectively. Toner dispenser 40 includes a container 44 storing a supply of toner particles therein. A foam roller 46 disposed in sump 48 coupled to container 44 dispenses toner particles into an auger 50. Auger 50 is made from a helical spring mounted in a tube having a plurality of apertures therein. Motor 52 rotates the helical spring to advance the toner particles through the tube so that toner particles are dispensed from the apertures therein. This process station may also be controlled by the control system regulating the energization of motor 52.

Figure 2:
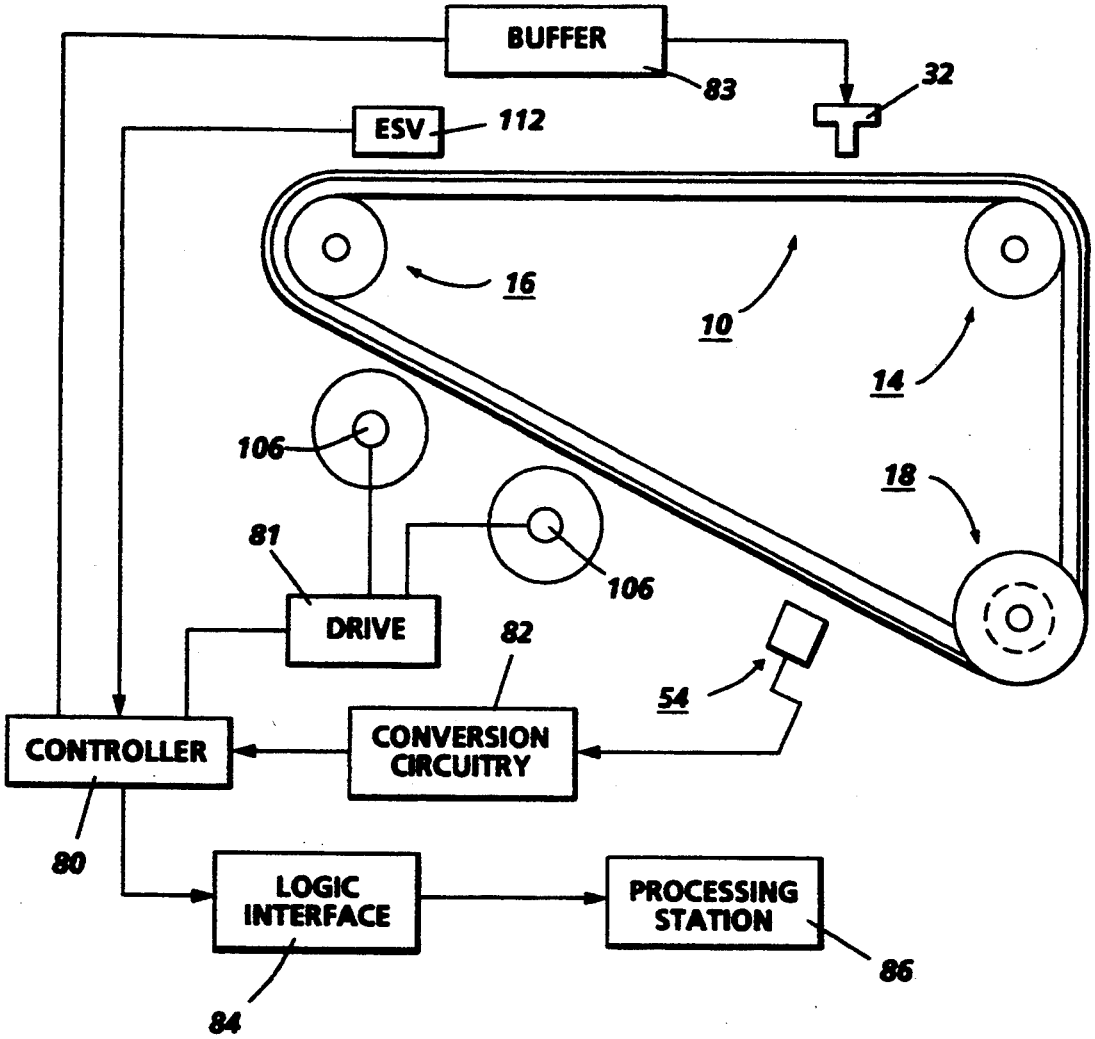
FIG. 2 is a schematic view showing the control system of the system shown in FIG. 1.

A densitometer 54, positioned adjacent the photoconductive belt between developer station C and transfer station D, generates electrical signals proportional to the developed test patch. These signals are conveyed to a control system and suitably processed and for regulating the processing stations of the printing machine. Further details of the control system are shown in FIG. 2. Preferably, densitometer 54 is an infrared densitometer, energized at 15 volts DC and about 50 milliamps. The surface of the infrared densitometer in about 7 millimeters from the surface of photoconductive belt 10. Densitometer 54 includes a semiconductor light emitting diode typically having a 940 nanometer peak output wavelength with a 60 nanometer one-half power bandwidth. The power output is approximately 45 milliwatts. A photodiode receives the light rays reflected from the developed half tone test patch and converts the measured light ray input to an electrical output signal. The infrared densitometer is also used to periodically measure the light rays reflected from the bare photoconductive surface, i.e. without developed toner particles, to provide a reference level for calculation of a suitable signal ratio. After development the toner powder image is advanced to transfer station D.

At transfer station D, a copy sheet 56 is moved into contact with the toner powder image. The copy sheet is advanced to transfer station D by a sheet feeding apparatus 60. Preferably, sheet feeding apparatus 60 includes a feed roll 62 contacting the uppermost sheet of a stack 64 of sheets. Feed rolls 62 rotate so as to advance the uppermost sheet from stack 64 into chute. Chute guides the advancing sheet from stack 64 into contact with the photoconductive belt in a timed sequence so that the toner powder image developed thereon contacts the advancing sheet at transfer station D. At transfer station D, a corona generating device 58 sprays ions onto the backside of sheet 56. This attracts the toner powder image from photoconductive belt 10 to copy sheet 56. After transfer, the copy sheet is separated from belt 10 and a conveyor advances the copy sheet, in the direction of arrow 66, to fusing station E.

Fusing station E includes a fuser assembly, indicated generally by the reference numeral 68 which permanently affixes the transferred toner powder image to the copy sheet. Preferably, fuser assembly 68 includes a heated fuser roller 70 and a pressure roller 72 with the powder image on the copy sheet contacting fuser roller 70. In this manner, the toner powder image is permanently affixed to sheet 56. After fusing, chute 74 guides the advancing sheet 56 to catch tray 76 for subsequent removal from the printing machine by the operator.

After the copy sheet is separated from photoconductive belt 10, the residual toner particles and the toner particles adhering to the test patch are cleaned from photoconductive belt 10. These particles are removed from photoconductive belt 10 at cleaning station F. Cleaning station F includes a rotatably mounted fiberous brush 78 in contact with photoconductive belt 10. The particles are cleaned from photoconductive belt 10 by the rotation of brush 78. Subsequent to cleaning, a discharge lamp (not shown) floods photoconductive belt 10 with light to dissipate any residual electrostatic charge remaining thereon prior to the charging thereof for the next successive imaging cycle.

As illustrated in FIG. 2, infrared densitometer 54 detects the density of the developed test patch and produces an electrical output signal indicative thereof. The electrical signal produced by the infrared densitometer is proportional to the change of reflected light intensity which is related to the change in density.

In addition, an electrical output signal is periodically generated by infrared densitometer 54 corresponding to the bare or undeveloped photoconductive surface. These signals are conveyed to controller 80 through suitable conversion circuitry 82. Controller 80 forms the ratio of the developed test patch signal/bare photoconductive surface signal and generates electrical error signals proportional thereto. The error signal is transmitted to logic interface 84 which processes the error signal so that it controls the respective processing station 86. For example, if the charging station is the processing station being controlled, the logic interface transmits the error signal in the appropriate form to the high voltage power supply to regulate charging of the photoconductive surface.

When toner concentration is being controlled, motor 52 (FIG. 1) is energized causing toner dispenser 40 to discharge toner particles into developer housing 42. This increases the concentration of toner particles in the developer mixture. During operation of the electrophotographic printing machine, any of the selected processing stations can be simultaneously controlled by the control loop depicted in FIG. 2. For example, in addition to controlling charging and toner concentration, the electrical bias applied to the developer roller may also be regulated. By regulating a plurality of processing stations, larger variations from the nominal conditions and faster returns to the nominal conditions are possible. Thus, the various printing machine processing stations have wider latitude.

Figure 3:
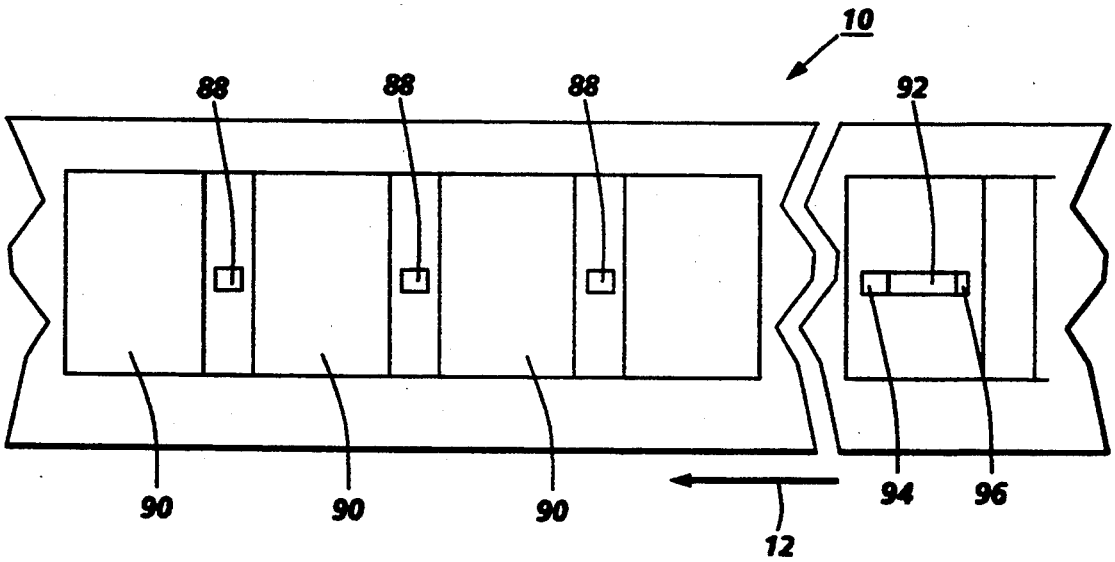
FIG. 3 illustrates a test patch formed on the image region of the photoreceptor in accordance with the present invention.

Referring now to FIG. 3, there is shown test patch 88 recorded in the interimage region of photoconductive belt 10. At the development station, the test patch is developed and infrared densitometer 54 (FIG. 2) detects the density of the developed test patch and generates an electrical signal. It has been discovered in accordance with the present invention that by the periodic development of a second test patch illustrated at 92, in the image area 90 of the photoreceptor, sufficient data can be acquired to not only sense the large solid area deterioration previously undetectable, but appropriate adjustments can be made as described below.

Figure 4:
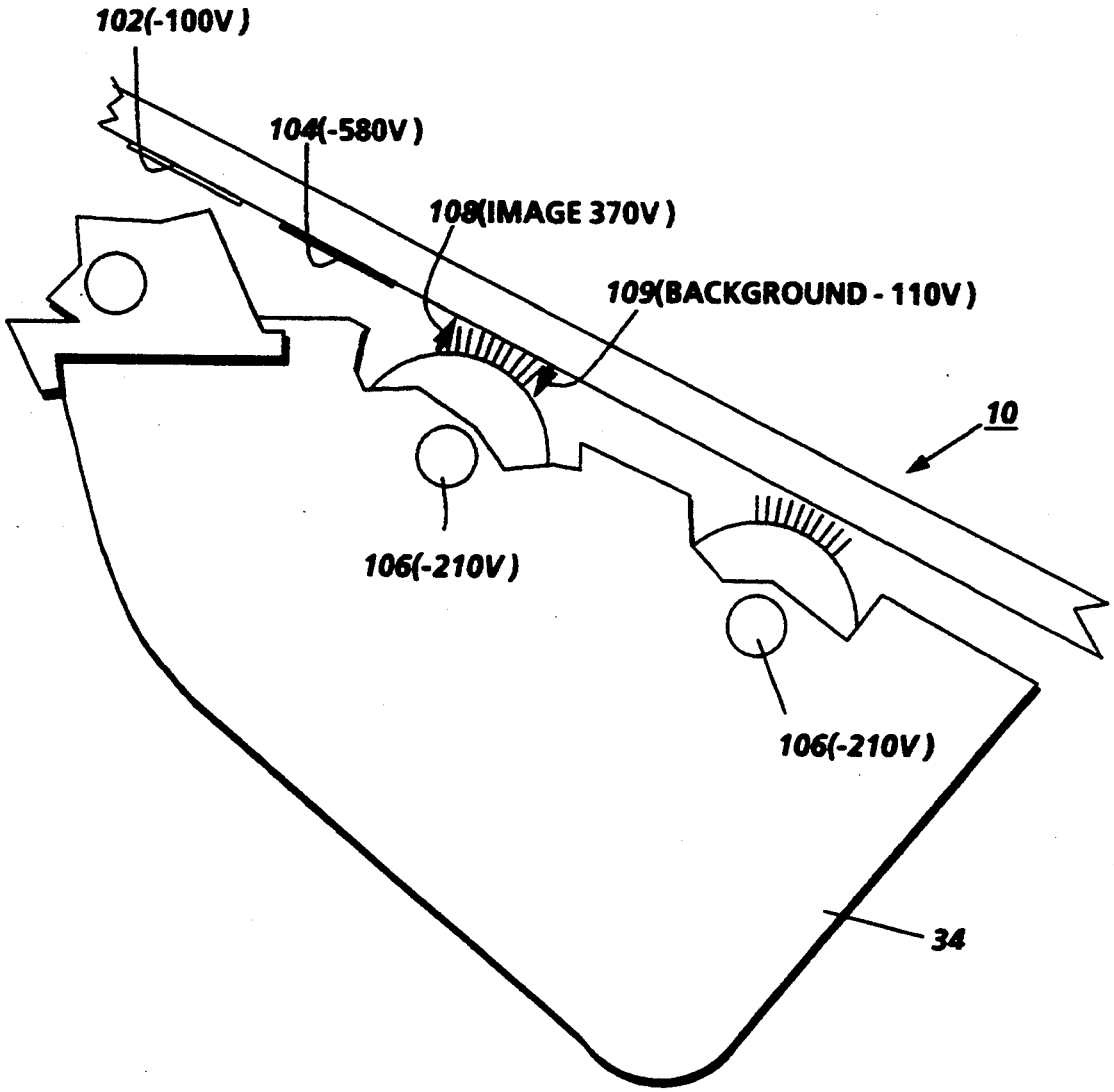
FIGS. 4 and 5 illustrate typical voltage potential relationships and fields between developer and photoreceptor in the system shown in FIG. 1.
Figure 5:
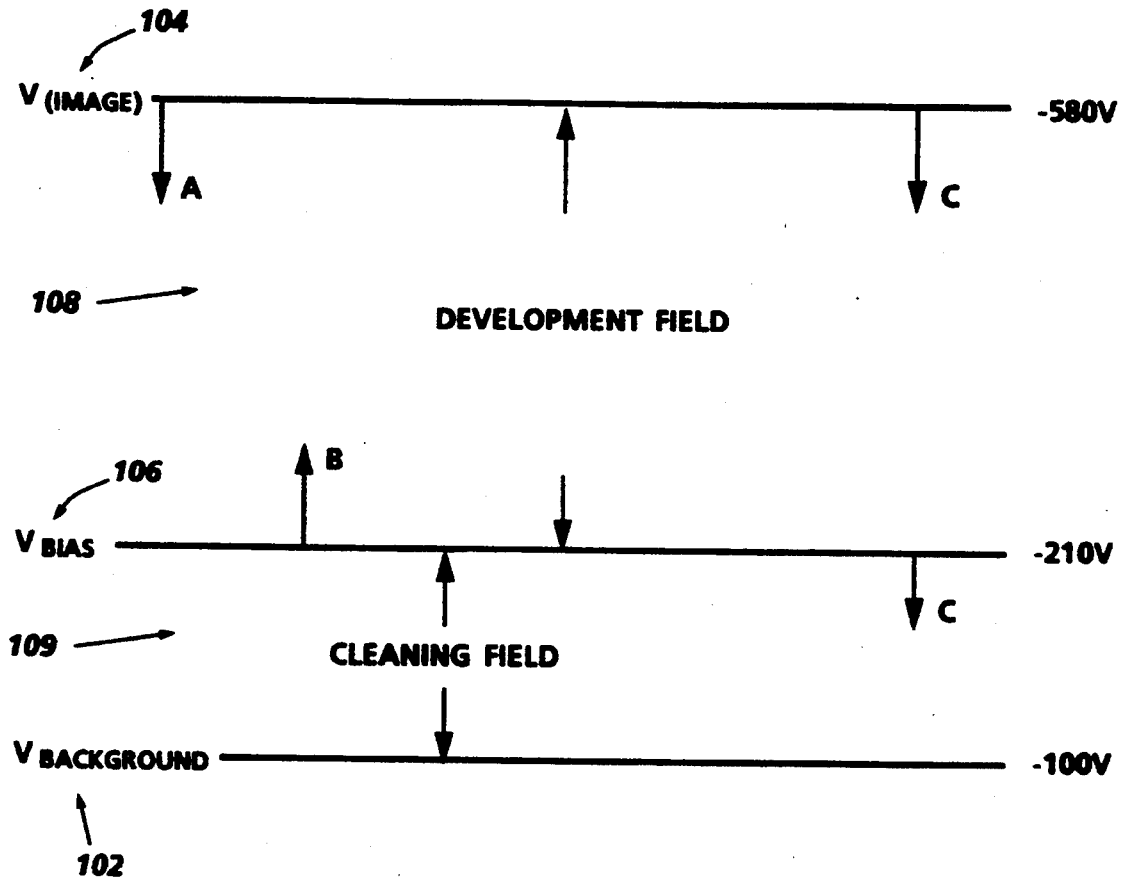

With reference to FIGS. 4 & 5, after the corona generating device 20 charges the photoconductive belt 10 to a relatively high substantially uniform potential, a document is illuminated by lamps 28. Light rays reflected from the document focus the light image of the original document onto the charged portion of the photoconductive belt to selectively dissipate the charge. The dark areas or image areas of the document reflect less light and therefore dissipate the charge on the photoconductor less than the white or background portions of the document which reflect a large proportion of the light to significantly dissipate the charge on the photoconductive belt. As a result, for example, in one particular embodiment, the charge on the photoconductive belt 10, representing the white or background areas is dissipated to a minus 100 volts and the portion on the photoconductive belt representing the black portions of the document are dissipated to a minus 580 volts as illustrated in FIG. 4 by 102 and 104 respectively. With a given bias on the developer rolls of a minus 210 volts as illustrated at 106, this results in a field of −370 volts, referred to as the development or image field illustrated at 108 between the image portions of the document and a field of 110 volts illustrated at 109 between the developer roll and the photoreceptor belt for the white or background areas, referred to as the cleaning field. Due to degradation of component parts of the Xerographic system such as the photoconductive belt and the developer system, various voltages such as the image voltage (−580), bias voltage (−210 V), and background voltage (−100 V) are subject to change which in turn alter the development filed 108 and cleaning field 109. In addition, as illustrated with reference to FIG. 5, a change in the image voltage or development field 108 will result in a change of the development field 109. To maintain a constant changing field 108, a suitable correction can be made to the biased voltage 106, however, by changing the biased voltage not only will a change be made to the development filed 108 but also to the cleaning field 110.

In accordance with the present invention, it is not only possible to measure and make adjustments for large solid development deterioration but also to be able to make the adjustments without an undesirable affect upon the development field or the cleaning field. There can be compensation for large solid area deterioration over the life of components without the addition of additional components and complexity to the system, but by the use of existing hardware.

It has been discovered that the density differential from the lead edge to the trail edge of a relatively large solid areas is measurable as the toner concentration decreases. Under normal process controls, the toner control patch is too small to be sensitive to this differential. In accordance with the present invention, with reference to FIG. 3, the density of the lead edge 94 of the large solid area developed patch 92, is determined as well as the density of the trail edge 96. If there is a difference in lead to trail edge reflectance, predetermined electrostatic parameters are adjusted to increase toner, while maintaining the white or background areas, referred to as the cleaning field. Due to degradation of component parts of the Xerographic system such as the photoconductive belt and the developer system, various voltages such as the image voltage (−580), and background voltage (1–110) are subject to change which in turn alter the development field 108 and cleaning field 109. In addition, as illustrated with reference to FIG. 5, a change in the image voltage will result in a change of the cleaning field 109. To maintain a constant development field 108, a suitable correction can be made to the bias voltage 106. However, by changing the bias voltage not only will a change be made to the development field 108 but also to the cleaning field 109.

In accordance with the present invention, it is not only possible to measure and make adjustments for large solid development deterioration but also to be able to make the adjustments without an undesirable affect upon the development field or the cleaning field. There can be compensation for large solid area deterioration over the life of components without the addition of additional components and complexity to the system, but by the use of existing hardware.

It has been discovered that the density differential from the lead edge to the trail edge of a relatively large solid area is measurable as the toner concentration decreases. Under normal process controls, the toner control patch is too small to be sensitive to this differential. In accordance with the present invention, with reference to FIG. 3, the density of the lead edge 94 of the large solid area developed patch 92, is determined as well as the density of the trail edge 96. If there is a difference in lead to trail edge reflectance, predetermined electrostatic parameters are adjusted to increase toner concentration to an optimum operating condition as well as to maintain proper developer fields.

In a preferred embodiment, at predetermined intervals, a dead cycle is initiated and the normal toner dispense suspended. This dead cycle for example, can be initiated at power on or after the production of a given number of copies or based upon time use of the machine. The patch generator 32 that normally provides the relatively small test patch 88 in the photoreceptor space between images 90, is used to project a large test patch 92 in the image area 90. Preferably, the control patch is one pitch long or the normal image cycle. This is the time period equivalent to the area of the photoreceptor to project and develop a single image.

The patch generator discharges the voltage at the lead and trail edge of the image to a lower level as is well known in order that the developed image will be in the active sense region of the infrared densitometer. The middle of the image remains at a nominal voltage level to simulate a long solid area. Once the image has been generated by the patch generator 32, and developed, the electrostatic volt meter 33 as illustrated in FIG. 1, measures the background voltage on the photoreceptor. That is, after the projection of the image, the potential on the photoreceptor belt corresponding to the white or background areas of the document is measured. This is the background voltage 102 as illustrated in FIGS. 4 and 5. The image of the patch 92 is developed and the lead and trail edge densities are measured by the densitometer. If the density of the trail edge is less than the lead edge density, certain parameters, in particular the developer bias and/the charge on the photoreceptor are changed based on the background voltage and the difference in the densitometer measurements.

Figure 6:
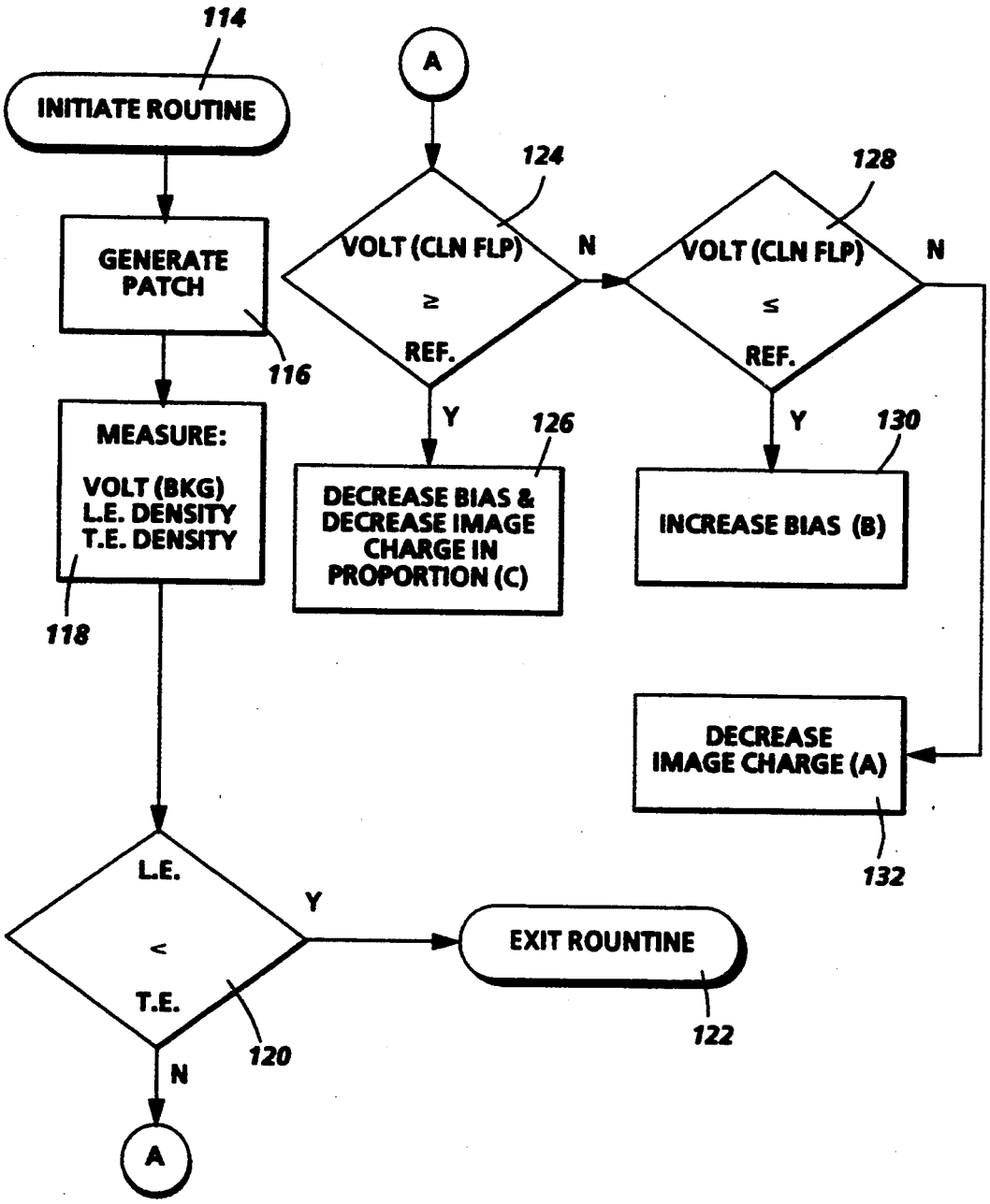
FIG. 6 is a flow chart illustrating the technique of responding to large solid area development deterioration to maintain toner concentration and developed mass at a constant level in accordance with the present invention.

In accordance with the present invention, with reference to FIG. 6, block 114 indicates the initiation of the large solid area test patch routine. It should be understood that it is a matter of design choice how often to generate the large solid test area patch. Block 116 illustrates the generation of the relatively large solid area test patch 92 as illustrated in FIG. 3, and suitably projected on to the photoreceptor belt 10 by the test patch generator 32. It should be understood that the test patch 92, and the smaller test patches 88 can be generated by suitable timing of the test patch generator 32. The key difference in the test patch 92 from the test patches 88 is the significant increase in the developed area of the test patch 92, in particular covering all or the greater portion of the image are 90 on the photoreceptor belt. In one embodiment, the length of the test patch 92 is one pitch or one timing cycle of the printer, a timing cycle in general being the time to lay down the image of a document on the photoreceptor belt 10.

Another key difference between the test patch 92 and the test patches 88 is the sufficient distance between the lead edge 94 and the trail 96 of the test patch 92 such that the difference in density between the developed patch at the lead edge 94 and the trail edge 96 is sufficient to be sensed and measured by a densitometer. It should be understood that the difference in density may only be negligible but that there is sufficient difference that is capable of measurement. Such a difference or distinction is not possible with prior art test patches such as illustrated at 88. In block 118 there is a determination of the background voltage on the photoreceptor as illustrated at 102 in FIGS. 4 and 5, as well as the determination of the lead edge density and trail edge density as measured by densitometer 54. It should also be understood that for a suitable adjustment of the xerographic process parameters in response to the density determinations, there is a determination of the bias voltage 106 at the developer station.

At decision block 120 there is a determination as to whether or not the lead edge density measurement is less than the trail edge density measurement. If the lead edge density measurement is less that the trail edge density measurement, then no adjustment need be made and as shown at 122 there is an exit of the routine. However, if the lead edge density is not less than the trail edge density, then one of three corrective actions is accomplished as illustrated in blocks 126, 130 and 132.

If the lead edge density is not less than the trail edge density, then the cleaning field potential must be taken into consideration. With reference to FIGS. 4 and 5 the cleaning field 109 potential is the difference between the bias voltage 106 and the background voltage 102. With reference to decision block 124, if the cleaning field potential is greater or equal to a given reference potential, then as illustrated at block 126, the corrective action is to decrease the bias voltage 106 and decrease the image charge or voltage 104 in proportion. The result is, with reference to FIG. 5, that by decreasing the bias voltage 106 the cleaning field is narrowed or reduced to the level of the reference voltage. However, since the lowering or decreasing of the bias voltage increases the development field 108, there is a corresponding decrease in the image charge 104 to maintain a consistent development field 108.

With reference to block 124, if the cleaning field potential is not greater or equal to the reference potential, then there is a determination as to whether or not the cleaning field potential is less than or equal to the reference voltage as illustrated at decision block 128. If the cleaning field potential is less than or equal to the reference potential, then an adjustment is made as shown in block 130. In particular, there is an increase in the bias voltage 106. An increase in the bias voltage 106 will increase the cleaning field potential to the level of the reference voltage. An increase in the bias potential will result in a decrease in the development field 108. A decrease in the development field will result in a determination of a low toner concentration from the sensing of the patches 88 in the normal xerographic control cycle. This will initiate the addition of toner to the development system. Thus, there will be a correction of the low toner concentration that caused the lead edge trail edge differential on patch 92. In a similar manner, even though in block 126 there is a decrease in the bias potential 106, there is a proportional decrease in the black image potential 104 with overall affect of a decrease in the development field 108. This will also result in a low toner concentration sensing for patches 88 resulting in the addition of toner to the development system to compensate for the lead edge to trail edge differential. With reference to block 132, if the cleaning field potential is correct with respect to a reference voltage, then it is not necessary to make any adjustment to the bias voltage to adjust the cleaning field voltage. It is only necessary to decrease the image charge 104 on the photoreceptor belt 10 in order to decrease the development potential with the result that the development field 108 is decreased. With the development field decreased, there will be a reading of less toner concentration on patches 88 with the result that toner will be added to the development system and the appropriate compensation will then be made to account for the lead edge trail edge differential.

Preferably, the sampled solid areas would be imaged on dead cycle frames and would thus not be printed to paper. The initial solid area reference would be sampled just after the materials had been changed and the electrostatic set up had been done. After the reference sample had been made, a solid would be sampled to check for the solids rendering problem at regular intervals. Upon detection of the solids rendering problem any of a number of actions could be taken. Firstly, the Xerographic set up could be adjusted to eliminate the problem. Secondly, a fault could be declared on systems which are not allowed to correct themselves. The fault could indicate that the print quality may be degraded until the machine is serviced. Thirdly, for machine interconnected to a remote expert system, a remote host could be informed of the problem for remote adjustment or dispatch of a service representative.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. In a machine having an imaging surface, a projecting system for projecting an image onto the imaging surface, a developer for application of toner to the image projected onto the imaging surface for transfer of the image to a copy sheet, the developer responding to given set points including developer bias and imaging surface potentials, the method of automatic adjustment of the developer comprising the steps of;

routinely sensing toner mass on a first developed patch within an interimage space on the imaging surface, adjusting the developer bias and imaging surface potentials in response to the routine sensing of the toner mass, upon predetermined machine operation, sensing toner mass on a second developed patch covering at least a portion of an image space on the imaging surface, and responding to said machine operation sensing to calibrate the set points of the developer for routinely sensing the toner mass on the first developed patch within the interimage space on the imaging surface.

2. The method of claim 1 wherein the second developed patch covering at least a portion of the image space on the imaging surface covers the entire image space on the imaging surface.

3. The method of claim 1 wherein sensing the toner mass on a second developed patch includes the steps of sensing a first edge of the second developed patch, sensing a second edge of the second developed patch, comparing the sensing of the first and second edges and calibrating the set points depending upon the comparison.

4. In a machine having an imaging surface, a projecting system for projecting an image onto the imaging surface, a developer controlled by given set points for application of toner to the image projected onto the imaging surface, the method of automatic adjustment of the developer set points comprising the steps of developing a test patch on the imaging surface, determining a difference in toner concentration at two locations on the test patch developed on the imaging surface, comparing a field potential at the developer to a reference potential, and selectively adjusting the set points in response to said comparing.

5. The method of claim 4 wherein said field potential is the difference between a developer bias voltage and a background voltage on the imaging surface.

6. The method of claim 4 wherein the step of selectively adjusting the set points in response to said comparing includes the step of proportionately decreasing a bias voltage and an image voltage on the imaging surface if the field potential is greater than the reference potential.

7. The method of claim 4 wherein the step of selectively adjusting the set points in response to said comparing includes the step of increasing a bias voltage if the field potential is less than the reference potential.

8. The method of claim 4 wherein the step of selectively adjusting the set points in response to said comparing includes the step of decreasing an image potential if the field potential is within a given range of the reference potential.

* * * * *